United States Patent [19]

Byars

[11] 4,432,550

[45] Feb. 21, 1984

[54] GOLF CLUB

[75] Inventors: Larry W. Byars, Greenville; Eric Jackson, Seneca, both of S.C.

[73] Assignees: Tranoco, Inc., Travelers Rest, S.C.; Dunlop Sports Company, div. Dunlop Tire and Rubber Corp., Buffalo, N.Y.

[21] Appl. No.: 398,967

[22] Filed: Jul. 16, 1982

[51] Int. Cl.[3] ..... A63B 53/04

[52] U.S. Cl. ..... 273/169; 273/172

[58] Field of Search ..... 273/173, 174, 169, 167 J, 273/168, 167 F, 167 A, 167 K, 172

[56] References Cited

U.S. PATENT DOCUMENTS

| | | | |
|---|---|---|---|
| 974,888 | 11/1910 | Jacobus | 273/173 |
| 1,435,318 | 11/1922 | Mattern | 273/173 |
| 1,463,533 | 7/1923 | Kurz | 273/173 |

FOREIGN PATENT DOCUMENTS

| | | | |
|---|---|---|---|
| 251902 | 5/1926 | United Kingdom | 273/169 |

*Primary Examiner*—George J. Marlo

*Attorney, Agent, or Firm*—B. P. Fishburne, Jr.

[57] ABSTRACT

A golf club, such as a driver, includes a body portion formed of natural uncompressed hard wood having an angled face on one side thereof. A wedge component formed of laminated highly compressed densified wood is bonded to the angled face of the body portion and forms a striking face and partial bottom face for the club head. Weight is concentrated near the striking face and bottom face to improve club controllability, balance and striking efficiency. Pre-weighing of wood veneers prior to compressing enables control and location of club head center of gravity. Final shaping of the club head is accomplished on a copying lathe.

7 Claims, 8 Drawing Figures

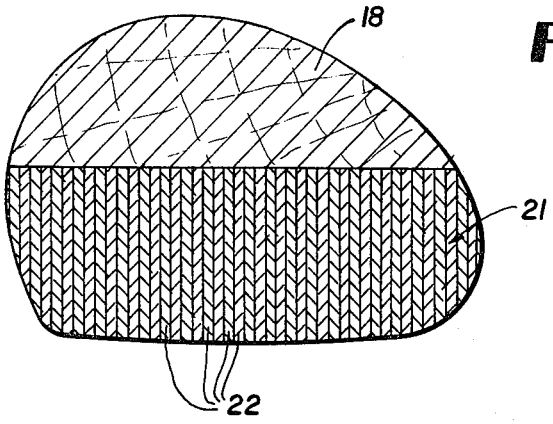
FIG. 5
FIG. 6
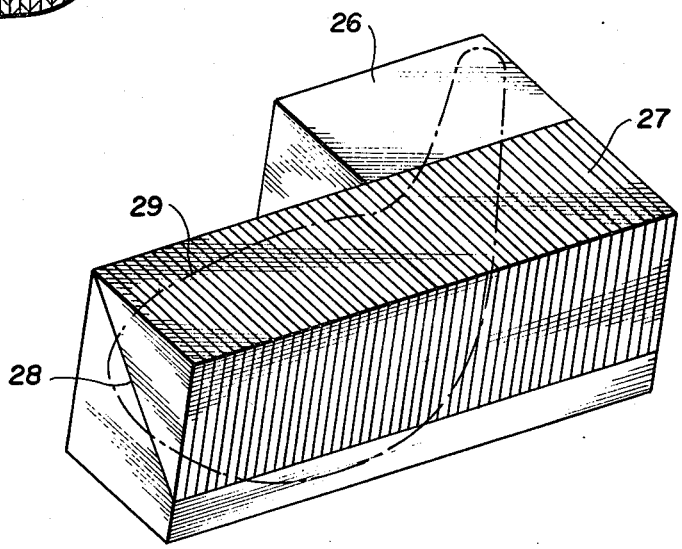
FIG. 7
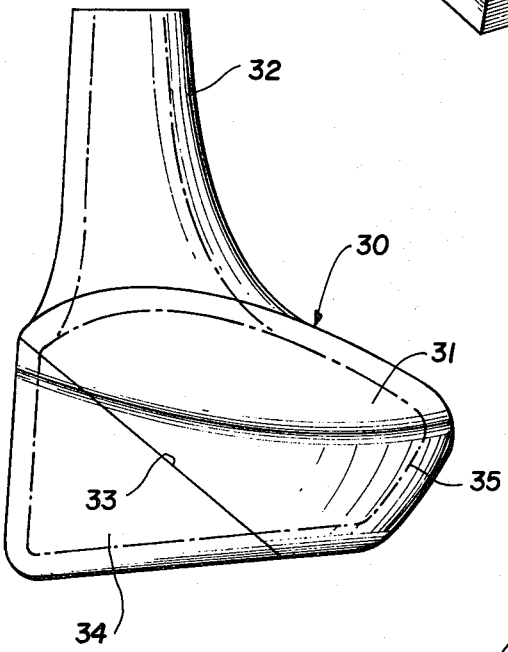
FIG. 8
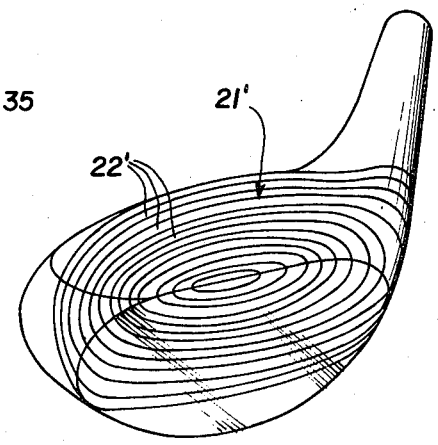

GOLF CLUB

BACKGROUND OF THE INVENTION

Modern-day golf clubs of the driver type are precision instruments required to satisfy the needs of amateur and professional golfers who are ever more demanding in their requirements for better clubs.

Currently, high quality drivers and the like have their heads formed of natural persimmon or other high quality hard woods either in solid or laminated form without compression to increase density. Such hard wood club heads require machining to accept a sole plate commonly employed for weighting and to improve scuff-resistance and require further machining on the striking face to permit attaching thereto a hard phenolic or other plastic insert. Such insert forms the striking surface of the finished club head and the insert, as well as the sole plate, is attached by means of screws which penetrate the wood of the head. Additional weighting of the club head with metal to achieve proper balance and weight distribution can be done in a number of ways, as by filling an additional recess immediately above the sole plate with lead or the like.

The above traditional features in today's clubs render them very costly and still fail to satisfy completely the demand for a club having better controllability, balance and striking efficiency. Many golfers, including professionals, search ceaselessly for a driver which presents the proper "feel" and operational efficiency which they seek, and some golfers complain that they can never find what they consider to be the ideal club to suit their particular needs.

It is, therefore, the object of this invention to more completely satisfy this need for a better and more efficient club of the driver type without increasing its manufacturing cost, and, to the contrary, simplifying considerably the manufacturing process for the club.

A further object of the invention is to provide a club head formed entirely of wood without the necessity of employing any metal attachments or inserts whatsoever unless, for example, a sole plate might be desired in some instances for appearance sake and to protect the sole of the club from direct ground contact during its use.

A further object is to eliminate the need for the customary phenolic insert on the striking face of the club and, in lieu thereof, to form the entire striking face from very hard densified wood of uniform hardness and strength.

Most importantly, it is an object of the invention to provide a golf club of the type mentioned whose head can be weighted and balanced with greater precision and by less costly methods than those currently practiced.

In accordance with the main essence of the invention, a club head body portion formed of natural hard wood without compression or densifying is provided with an angled face to which is attached adhesively a wedge component completing the formation of the club head. The wedge component is formed entirely of very hard compressed and densified laminated wood whose veneers are pre-weighed to control weight with precision during compression. The utilization of the compressed densified laminated wood component enables locating the center of gravity of the club head close to the point of impact with a golf ball, which in turn makes for better controllability of the club with less tendency for the club to twist or distort under impact.

Other features and advantages of the invention will become apparent during the course of the following description.

BRIEF DESCRIPTION OF THE DRAWINGS

FIG. 5 is a cross section taken at right angles to FIG. 4 on line 5—5 of FIG. 3.

FIG. 6 is a perspective view of a club blank prior to final shaping.

FIG. 7 is an elevational view of an oversized turned club head blank prior to final turning on a lathe.

FIG. 8 is a perspective view similar to FIG. 3 showing the club head made in accordance with the invention and having a densified laminated wedge component whose laminations are substantially perpendicular to those of the club head in FIGS. 3–5.

DETAILED DESCRIPTION

Figure 1:
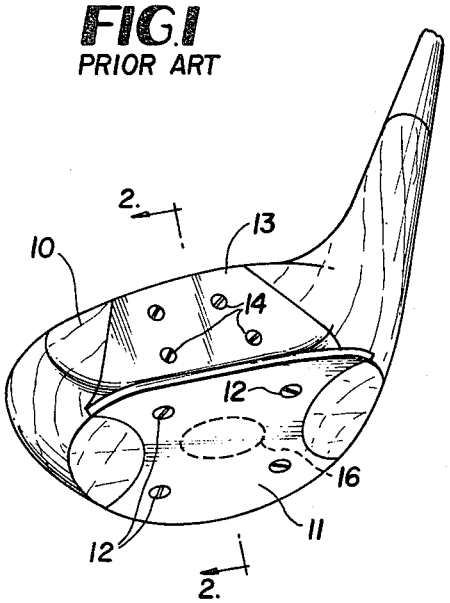
FIG. 1 PRIOR ART
FIG. 1 is a perspective view of a golf club head according to the prior art.
Figure 2:
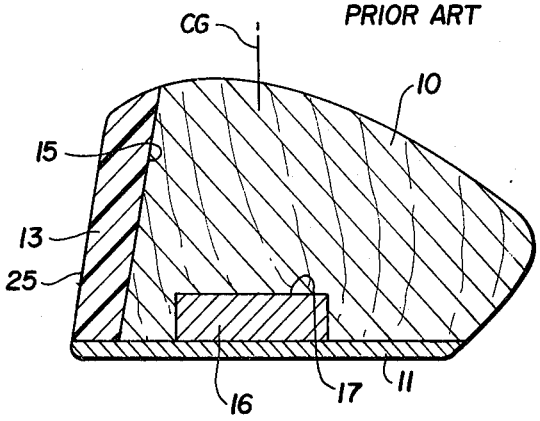
FIG. 2 PRIOR ART
FIG. 2 is a cross section taken on line 2—2 of FIG. 1.

Referring to the drawings in detail wherein like numerals designate like parts, and referring intially to FIGS. 1 and 2 showing a typical prior art driver, the driver head 10 is formed of persimmon or other high quality hard wood in the natural uncompressed state. The club head 10 is machined to accept a metal sole plate 11 attached by means of screws 12. The striking face of the club head is formed by a phenolic or other plastic insert 13 attached with additional screws 14 and seated in a machined recess 15 in accordance with conventional practice. Additional balancing and weighting material 16 is placed within a machined cavity 17 immediately above the sole plate 11.

Figure 3:
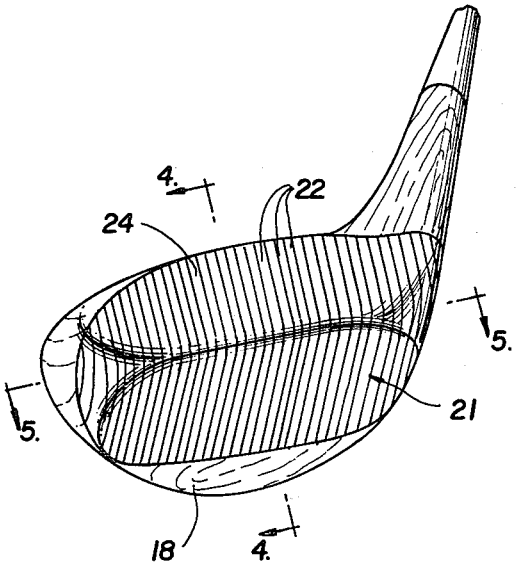
FIG. 3 is a perspective view of the club head made according to the present invention.
Figure 4:
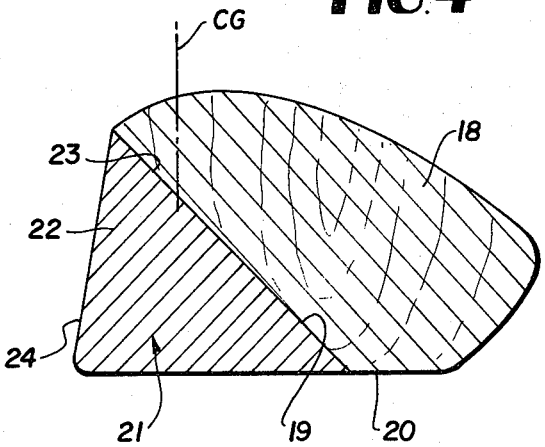
FIG. 4 is a cross section taken on line 4—4 of FIG. 3.

The present invention is illustrated in FIGS. 3 through 8 to which attention is now directed. In FIGS. 3 through 5, a club head body portion 18 is formed of natural uncompressed wood such as persimmon and this body portion is cut with a saw to form an angled forward face 19 thereon disposed substantially at 45 degrees to a horizontal plane defining the bottom face or sole 20 of the club head. The club head is further composed of a wedge component 21 according to a main feature of the invention. The wedge component comprises a multiplicity of pre-weighed wood laminations or veneers 22 whose weights are controlled with precision. The wedge component composed of the veneers 22 is compressed and densified to a uniform very hard state in accordance with the teachings of prior U.S. Pat. Nos. 3,788,929; 3,698,445; 4,136,722 and 4,199,632.

The compressed densified wedge 21 has an interior or rear flat face 23 which abuts the angled face 19 and is permanently bonded thereto by means of a strong adhesive of a type well known in the art. In effect, the uncompressed natural wood body portion 18 and the laminated and compressed wedge component 21 become permanently and integrally joined to produce an all-wooden driver head of the desired shape. No metal or plastic parts whatsoever need be employed. The club may be given a beautiful finish including varnishing and/or staining through techniques known in the art.

Most importantly, by utilizing the densified wedge 21, the club head center of gravity can be located comparatively closer to the striking face 24 defined by the wedge 21 than in the prior art depicted in FIG. 2 where the center of gravity is more distant from the striking face 25 of the club head. Also, by controlling the weight of the veneers 22, the end weight of the wedge component 21 can be controlled with precision and the weight of the club head can be concentrated near the striking face 24 and near the bottom surface of the club head as well.

As best shown in FIG. 3, the entire striking face 24 of the club head according to this invention is formed by the laminated densified wedge 21, and a substantial portion of the bottom face or sole of the club head is occupied by the wedge, FIG. 4. The compressed densified laminated wedge element 21 in effect extends from the heel to the toe of the club head, FIG. 3, and from its bottom face or sole substantially to its top, whereby the substantially upright forward face of the wedge element 21 spans the entire striking face of the finished club head. The weight and balance of the club, its feel, and striking efficiency can be adjusted with precision by varying the extent to which the bottom surface of the club head is made up of the densified wedge component 21. The club head can in fact be customized to the needs of various golfers solely by regulating the dimensions of the wedge 21 relative to the body portion 18 in the manufacturing process, without the use of any metal weights or attachments.

In FIGS. 3 to 5, the veneers 22 extend vertically in the club head for appearance sake. They may, in fact, extend in any direction. FIG. 8, for example, shows a wedge component 21' for a club head formed of wood veneers 22' which are horizontally disposed substantially at right angles to the veneers 22.

In the actual manufacturing process shown in FIG. 6, a rough sawn blank 26 of persimmon or other acceptable uncompressed wood is united adhesively to a wedge blank 27 of laminated compressed and densified wood, as previously described. The two blanks are bonded in permanently assembled relationship at meeting angled faces 28. Following this uniting, the composite blank is turned in a copying lathe to produce the desired finished club head 29 shown in phantom lines in FIG. 6.

In accordance with an alternative procedure, an oversized turned blank 30 can be produced consisting of an uncompressed hard wood body portion 31 having a shank 32 and angled face 33. The body portion 31 is joined by adhesive at the face 33 with the laminated compressed and densified wedge 34, as previously described. After uniting in this manner, the oversized blank 30 is turned in a copying lathe to the desired club head shape and size shown at 35 in phantom lines in FIG. 7.

The advantages inherent in the article and method according to the invention are numerous and should be well understood by those skilled in the art. A better-looking all-wood club can be produced as well as a club having improved balance, swingability and controllability. The finished club is more durable particularly on its striking face because of the extreme hardness of the densified wood wedge. The location of the club head center of gravity can be controlled with greater precision and without resorting to costly and cumbersome metal weighting attachments as in the prior art. The usual phenolic striking face insert is no longer necessary and the club has improved striking efficiency with the described densified wedge component. The weight can be concentrated with increased accuracy near the lower front corner of the club head where the ball striking face 24 meets the sole or bottom face 20. This is very desirable.

It is to be understood that the form of the invention herewith shown and described is to be taken as a preferred example of the same, and that various changes in the shape, size and arrangement of parts may be resorted to, without departing from the spirit of the invention or scope of the subjoined claims.

1. A golf club head comprising a body portion formed of conventional uncompressed hard wood and being arranged and shaped to form the rear part of a completed club head, said body portion having a forward flat inclined face extending substantially from top to bottom and front to back thereof and rising at an acute angle from a generally level plane occupied by the sole of the club head, a unitary preformed wedge element formed from a multiplicity of pre-weighed highly compressed and densified permanently united wood veneers, the wedge element having a rear flat inclined face shaped to register with the margin of the forward inclined face of the body portion, the two inclined faces abutting and being permanently united in the finished club head, the wedge element having a bottom face disposed in said generally level plane and defining nearly the entire sole of the club head and extending substantially from the heel to the toe of the club head without interruption, and the wedge element further including a substantially upright forward face extending substantially from the top to the bottom of the club head and from the heel to the toe thereof without interruption and forming the striking face of the club head.

2. A golf club head as defined in claim 1, which is shaped in its completed state to form the head of a driver or like golf club.

3. In a golf club, a substantially all wooden club head having a body portion formed of uncompressed wood, said body portion having a forward inclined face which slopes upwardly and forwardly from the bottom of the body portion to substantially the top thereof and also extends for substantially the entire length of the body portion in the heel to toe direction on the club head, and a wedge element formed of compressed and densified wood and having a rear inclined face abutting and registering substantially with the forward inclined face of the body portion, the wedge element and body portion being permanently adhesively united at the abutting inclined faces, the wedge element having a bottom face disposed in a generally level plane flush with the bottom of the body portion and forming the greatest part of the sole of the completed club head and extending substantially from the heel to the toe of the club head and from its front to a point near the rear thereof, and the wedge element further including a generally upright front striking face extending substantially from top to bottom of the club head and from heel to toe thereof in the completed club head.

4. In a golf club as defined in claim 3, and the wedge element comprising a multiplicity of relatively thin pre-weighed compressed, densified and adhesively united wood veneers, enabling the location of the center of gravity of the wedge element and the completed club head to be controlled and predetermined with substantial precision, and the geometrical shape of the compressed and densified wedge element causing the center of gravity of the completed club head to be located relatively near the sole of the club head and the striking face thereof.

5. In a golf club as defined in claim 4, and said wood veneers extending in substantially parallel relationship between the top and bottom of the wedge element in the completed club head.

6. In a golf club as defined in claim 4, and said wood veneers extending substantially in parallel relationship between the heel and toe of the club head on the wedge element.

7. A golf club head such as the head of a driver formed substantially of wood and comprising a rearward uncompressed hard wood body portion having a forward inclined substantially flat face which extends substantially for the height of the body portion and for the length thereof in the heel to toe direction, and a wedge element formed of a multiplicity of stacked, compressed and densified adhesively united wood veneers including a rear inclined substantially flat face abutting, substantially registering with and affixed to said inclined face of the body portion to complete the club head, the wedge element having substantially a right triangular configuration in cross section on a substantially vertical plane through the club head from front to back thereof, and the wedge element defining on the club head a front ball striking face extending substantially from the sole of the club to its top and also defining substantially the entire sole of the club, the compressed and densified wedge element also serving to establish and locate the center of gravity of the club head relatively near the ball striking face and sole of the club head.

* * * * *